US007322113B2

(12) United States Patent
Tetreault et al.

(10) Patent No.: US 7,322,113 B2
(45) Date of Patent: Jan. 29, 2008

(54) CUTLERY IMPLEMENT AND BLOCK

(75) Inventors: Joel Tetreault, Haskins, OH (US); Brian Demers, Huntersville, NC (US)

(73) Assignee: Calphalon Corporation, Freeport, IL (US)

( * ) Notice: Subject to any disclaimer, the term of this patent is extended or adjusted under 35 U.S.C. 154(b) by 270 days.

(21) Appl. No.: 11/016,321

(22) Filed: Dec. 20, 2004
(Under 37 CFR 1.47)

(65) Prior Publication Data

US 2006/0117575 A1 Jun. 8, 2006

Related U.S. Application Data

(63) Continuation-in-part of application No. 11/002,722, filed on Dec. 3, 2004.

(51) Int. Cl.
*A47F 5/16* (2006.01)
*A47F 7/00* (2006.01)

(52) U.S. Cl. ..... 30/298.4; 211/70.7; D7/637

(58) Field of Classification Search ..... 30/298.4, 30/340; 211/70.7; D7/637, 638, 639, 640, D7/641

See application file for complete search history.

(56) References Cited

U.S. PATENT DOCUMENTS

| | | | | |
|---|---|---|---|---|
| 336,314 | A | | 2/1886 | Hatfield |
| 656,457 | A | | 8/1900 | Hirsch |
| 1,806,244 | A | | 5/1931 | Eichanan-Echikson |
| 1,820,234 | A | | 8/1931 | Less |
| 2,300,671 | A | | 11/1942 | Howard |
| 3,191,460 | A | | 6/1965 | Christian |
| 3,842,501 | A | | 10/1974 | Honma |
| 3,980,608 | A | | 9/1976 | Faltersack |
| 4,272,332 | A | | 6/1981 | Probost |
| D266,392 | S | | 10/1982 | Hoffberger |
| D271,171 | S | * | 11/1983 | Kinkade ..... D7/637 |
| 4,561,548 | A | * | 12/1985 | Call ..... 211/70.7 |
| 4,575,939 | A | * | 3/1986 | Buchtel ..... 30/298.4 |
| 4,578,864 | A | | 4/1986 | Hoffman |
| D292,359 | S | * | 10/1987 | Daw ..... D7/637 |
| 4,866,845 | A | * | 9/1989 | McEvily ..... 30/138 |
| 4,881,430 | A | | 11/1989 | Hubbard |
| 4,955,139 | A | | 9/1990 | Clotten et al. |
| 4,969,267 | A | | 11/1990 | Anenberg |
| 5,081,770 | A | | 1/1992 | Fierthaler |

(Continued)

FOREIGN PATENT DOCUMENTS

EP 0 520 206 A1 5/1992

OTHER PUBLICATIONS http://ww2.williams-sonoma.com/cat/pip.cfm?; website for Henckels Twin Cuisine 10-Piece Set knives and block, date: Dec. 20, 2004.

*Primary Examiner*—Hwei-Siu Payer
(74) *Attorney, Agent, or Firm*—Foley & Lardner LLP

(57) ABSTRACT

A cutlery implement includes a blade, a handle and a bolster. The bolster is positioned at a balance point, in front of the back edge of the blade. The bolster has a tapered thickness to create a smooth transition from the blade to the handle. The bolster provides a more comfortable gripping portion, such that user may safely grip the cutlery implement at its balance point. A cutlery block is configured to store a cutlery implement having a bolster with a tapered thickness such that the blade is safely concealed.

21 Claims, 18 Drawing Sheets

U.S. PATENT DOCUMENTS

| | | | | | |
|---|---|---|---|---|---|
| 5,131,152 | A | | 7/1992 | Wordtmann et al. | |
| 5,210,925 | A | | 5/1993 | Morgulis | |
| D338,376 | S | * | 8/1993 | Ulber | D7/637 |
| D360,810 | S | * | 8/1995 | Humaj | D7/637 |
| 5,528,834 | A | | 6/1996 | Seber | |
| D382,774 | S | * | 8/1997 | Cohen et al. | D7/637 |
| D400,059 | S | | 10/1998 | Cohen | |
| D421,879 | S | * | 3/2000 | Miller et al. | D7/637 |
| 6,079,108 | A | * | 6/2000 | Lin | 30/298.4 |
| D441,617 | S | * | 5/2001 | Lin | D7/640 |
| 6,371,312 | B1 | * | 4/2002 | Tsuchida | 211/70.7 |
| D462,580 | S | * | 9/2002 | Rorke | D7/641 |
| D471,072 | S | * | 3/2003 | Gordner | D8/93 |
| D478,787 | S | * | 8/2003 | Logiudice et al. | D7/637 |
| 6,619,487 | B2 | | 9/2003 | Stuchlik, III | |
| 6,625,890 | B2 | | 9/2003 | Hufnagel et al. | |
| 6,662,453 | B1 | * | 12/2003 | Stuckey et al. | 30/298.4 |
| 6,701,624 | B1 | | 3/2004 | White | |
| D488,677 | S | * | 4/2004 | Reichenbach et al. | D7/637 |
| 2002/0144410 | A1 | | 10/2002 | Hufnagel et al. | |
| 2003/0101597 | A1 | | 6/2003 | Chen | |
| 2003/0226263 | A1 | | 12/2003 | Fedor et al. | |
| 2004/0123471 | A1 | | 7/2004 | Onion | |
| 2006/0022094 | A1 | * | 2/2006 | Schmidt et al. | 248/37.3 |

* cited by examiner

CUTLERY IMPLEMENT AND BLOCK

CROSS-REFERENCE TO RELATED PATENT APPLICATIONS

The instant application is a continuation-in-part of U.S. patent application Ser. No. 11/002,722, filed on Dec. 3, 2004, the disclosure of which is incorporated herein by reference in its entirety.

BACKGROUND OF THE INVENTION

The present invention generally relates to cutlery, including knives and other utensils used in preparing food. More particularly, the invention relates to a cutlery device with a bolster that facilitates use and handling of the cutlery implement. In addition, the invention relates to a cutlery block that facilitates storage of cutlery implements.

Cutlery devices such as knives are well known and are provided in various forms for particular uses. Generally, a knife has a blade portion at one end and a handle portion at an opposite end. A tang, which is typically formed integrally with the blade portion, extends into the handle portion and is surrounded by material that defines a predetermined or designated area where the knife can be held.

Generally, however, these areas do not provide the level of comfort and control that one needs when handling cutlery. Consequently chefs and other food service professionals may often grasp the knife in a different manner. Specifically, professionals tend to grip a knife forward of the handle so that their hand is partially on the blade portion.

FIGS. 1A and 1B illustrate a prior art knife 1, and the hand position 8 utilized by a professional. As illustrated, the bolster 4 of the knife 1 generally dictates the hand position 8 of the user. The ideal hand position 8 for a user extends forward of the bolster area 4, partially on the blade portion 6. This places the hand slightly forward of the rear edge 10 of the blade portion 6. Specifically, the user grips the knife by placing the thumb and forefinger over the bolster and blade. The remaining three fingers of the hand wrap around the handle. Thus, the user still may experience discomfort and blistering because of where they must position their hand on the knife.

Generally, the bolster portion of a knife creates a hard edge. A user holding the knife with such a hard edge may experience pain and blistering after prolonged use of the knife. In addition, the hard edge of a bolster does not provide the user with an optimal safe and secure grip. To avoid this hard edge, a user may hold the knife in another area, which results in the user's hand not being centered across the length of the knife. Holding the knife off-center is likely to afford the user less control and result in inefficient use. Contour-shaped, ergonomic handles are known in the art. Such handles, however, are often thick and bulky and do not provide for comfortable use by consumers. Moreover, the handles known in the art are not as comfortable when gripped between the thumb and forefinger over the bolster and the blade, as is typical for professional users.

One known cutlery knife has a blended bolster area, that is, a bolster that has a more tapered edge. The bolster is located past the rear edge of the blade, closer to the handle. Due in part to the bolster's position, this knife has several drawbacks because the ability to control the knife still requires the user to grip a substantial amount of the blade area, which is typically thinner and thus harder to grip.

As a result, there is a need for a cutlery implement that has a bolster that allows the user to effectively control the knife while limiting discomfort. More specifically, it is desirable to provide cutlery with a bolster that is comfortable for both professional and ordinary consumers, that is cutlery that may be gripped comfortably by either lay users or professional users.

Cutlery blocks are well known and are provided in various forms. Generally, cutlery blocks include slots of uniform width, which are adapted to store conventional cutlery devices, including the aforementioned conventional cutlery implements.

SUMMARY OF THE INVENTION

According to an aspect of the invention, a cutlery block is provided. The cutlery block includes a block having a receiving surface and a plurality of storage slots formed on the receiving surface configured to receive and store a corresponding plurality of cutlery implements. At least one of the plurality of storage slots has a lower portion and an upper portion. At least one of the plurality of cutlery implements has a blade portion having a working surface, a handle portion connected to the blade portion and a bolster having a tapered thickness. At least one of the plurality of storage slots is configured to store at least one of the plurality of cutlery implements so that the working surface of the blade portion located forward of the bolster is concealed within the block, beneath the receiving surface. The working surface of the cutlery implement located below the bolster is concealed by the upper portion of the storage slot. The bolster is left exposed outside the receiving surface, above the lower portion of the storage slot.

According to a feature of the invention, the plurality of storage slots are rectangular in shape.

According to yet another feature of the invention, the receiving surface has a plurality of tiered surfaces and a transitional surface located between each of the plurality of tiered surfaces. Each of the plurality of tiered surfaces is flat.

According to still another feature of the invention, the transitional surface between each of the plurality of tiered surfaces is at a ninety degree angle with each of the plurality of tired surfaces.

According to another feature of the invention, the transitional surface between each of the plurality of tiered surfaces is curved.

According to another feature of the invention, the receiving surface is flat and sloped at an angle.

According to still another feature of the invention, at least one of the plurality of storage slots is configured so that the lower portion is positioned on a lower tiered surface and the upper portion is positioned on an upper tiered surface. The storage slot extends across the lower tiered surface, the upper tiered surface and the transitional surface located therebetween, such that the working surface of the blade portion located forward of the bolster is concealed below the receiving surface. The working surface of the cutlery implement located below the bolster is concealed by the upper tiered surface. The bolster is left exposed above the lower tiered surface.

According to another feature of the invention, the receiving surface and the plurality of storage slots are arranged so that each of the plurality of cutlery implements are oriented vertically when they are stored in the storage slots.

According to another feature of the invention, the receiving surface has three tiered surfaces and a transitional surface positioned between each tiered surface.

Preferably, a cutlery block of the present invention includes a support portion connected to the block and a plurality of base portions attached to the block and the support portion so that the cutlery block is capable of freestanding on a horizontal surface. Preferably, the block is made from wood and has a varnished finish.

According to another aspect of the invention, a cutlery set comprises a block having a receiving surface and a plurality of storage slots formed on the receiving surface configured to receive and store a corresponding plurality of cutlery implements. Each storage slot has a lower portion and an upper portion. At least one of the plurality of cutlery implements has a blade portion having a working surface, a handle portion connected to the blade portion and a bolster having a tapered thickness. At least one of the plurality of storage slots is configured to store at least one of the plurality of cutlery implements whereby the working surface of the blade portion located forward of the bolster is concealed within the block, beneath the receiving surface. The working surface located below the bolster is concealed by the upper portion of the storage slot. The bolster is left exposed outside the receiving surface, above the lower portion of the storage slot.

DETAILED DESCRIPTION OF THE PREFERRED EMBODIMENTS

Embodiments of the present invention will be described below with reference to the accompanying drawings. It should be understood that the following description is intended to describe exemplary embodiments of the invention, and not to limit the invention.

Figure 1A:
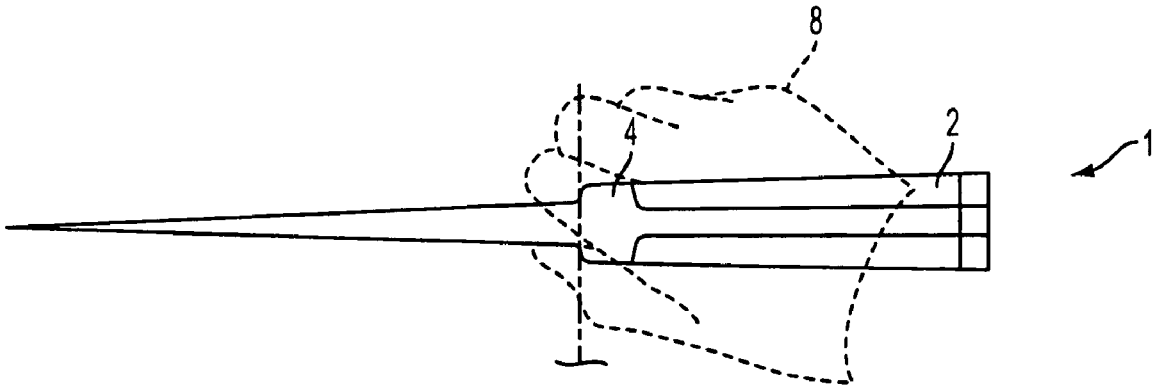
FIG. 1A PRIOR ART
FIG. 1A is a top view of a prior art cutlery implement.
Figure 1B:
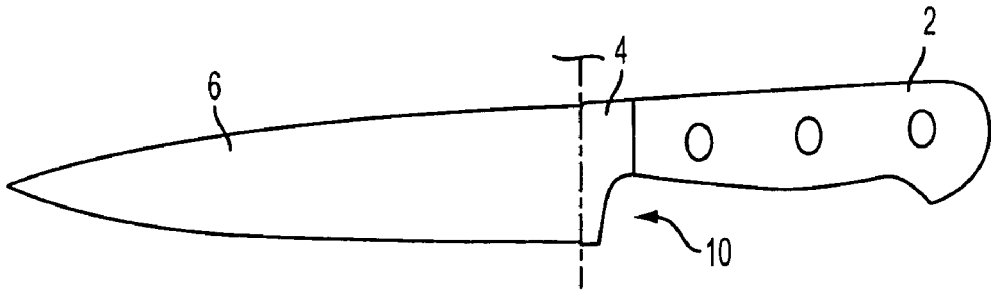
FIG. 1B PRIOR ART
FIG. 1B is a side view of a prior art cutlery implement.
Figure 2:
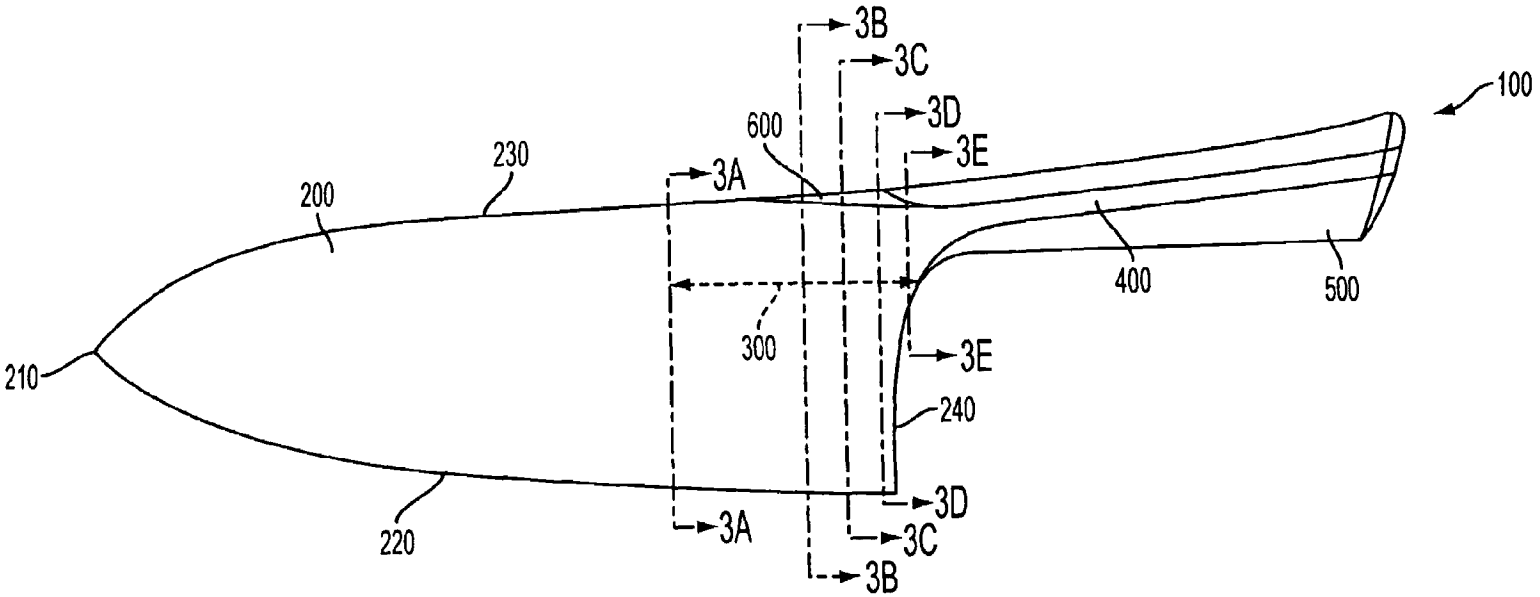
FIG. 2 is a side view of a cutlery implement according to an embodiment of the present invention.
Figure 3E:
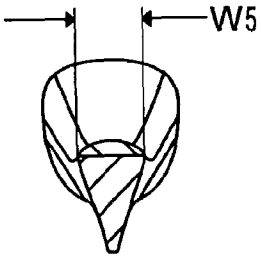
FIGS. 3(*a*)-3(*e*) are cross sectional views of the bolster portion 300 illustrated in FIG. 2.
Figure 3D:
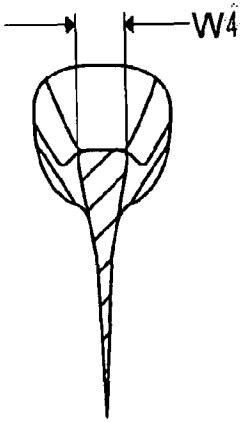
Figure 3C:
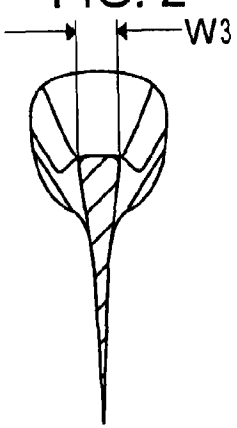
Figure 3B:
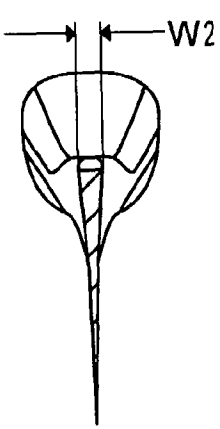
Figure 3A:
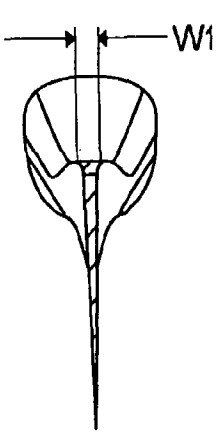

FIG. 2 shows a cutlery implement 100 according to an exemplary embodiment of the present invention, specifically a chef's knife. The cutlery implement 100 includes a blade portion 200, a bolster portion 300 and a tang 400 enclosed in a handle portion 500. The blade portion 200 has at least one point 210, a cutting surface 220, a top edge 230 opposite the cutting surface 220 and a rear edge 240 opposite the point 210. The bolster portion 300 is formed so as to provide an ergonomic gripping position.

Located within the handle 500 is a tang 400 that extends substantially along the entire length of the handle 500. A bolster portion 300 is located between the tang 400 and the blade portion 200. In one aspect of the present invention, the tang 400 is welded to the blade portion 200.

The handle portion 500 may be formed in an injection molding process wherein the plastic material is injected into a mold surrounding the tang 400. Preferably, the blade portion 200 is made from a core piece of VG-10 steel in which 16 to 32 layers of steel are folded over in a layered pattern creating a unique pattern called Damascus. The handle portion 500 is then injected and the blade portion 200 is polished.

Figure 9:
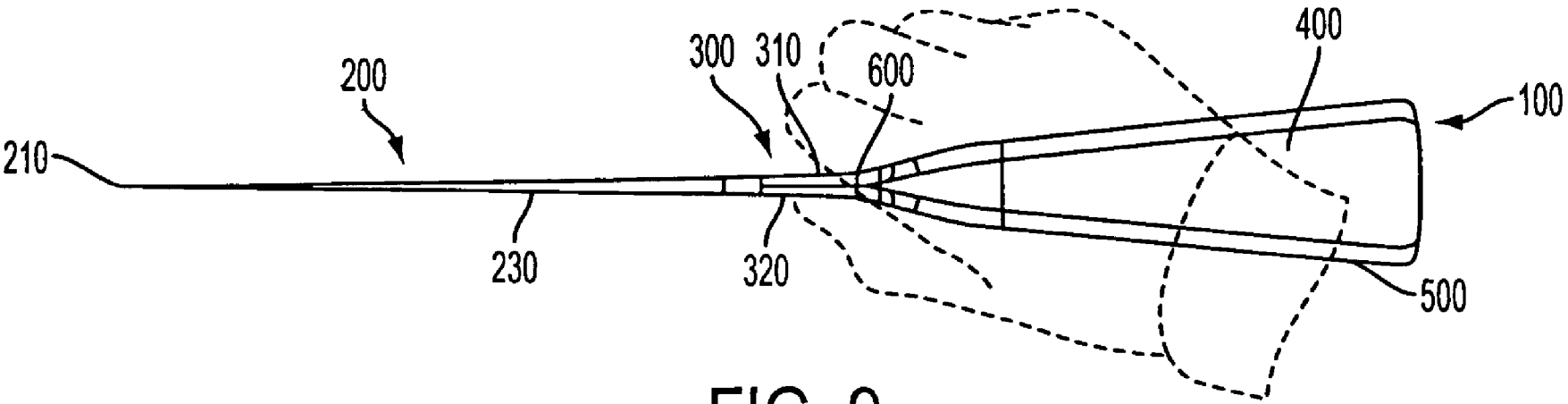
FIG. 9 is a top view of the cutlery implement of FIG. 2.

According to another aspect of the invention, the bolster portion 300 is configured to provide a comfortable fit for the user. As seen in FIG. 9, an experienced chef will typically hold a cutlery implement at a balance point 600 with the thumb and forefinger extending over the bolster portion 300 and blade portion 200. The remaining three fingers of the hand will wrap around the handle portion 500.

According to one aspect of the invention, the bolster portion 300 is positioned forward of the rear edge 240. That is, in moving from the blade's point 210 to the tang 400, the bolster portion 300 is positioned before the rear edge 240. This allows a professional to hold the cutlery implement 100 comfortably at the balance point 600. The bolster portion 300 has a smooth tapered surface which joins the tang 400 and the blade portion 200 in a curved manner.

According to still yet another aspect of the invention, the bolster portion 300 is located at a position forward of the balancing point 600. Preferably, the bolster portion 300 has a cross sectional area such that the bolster portion's 300 cross sectional area along the top of the blade portion 230 is greater that the bolster portion's 300 cross sectional area along the cutting surface of the blade portion 220.

Figure 4:
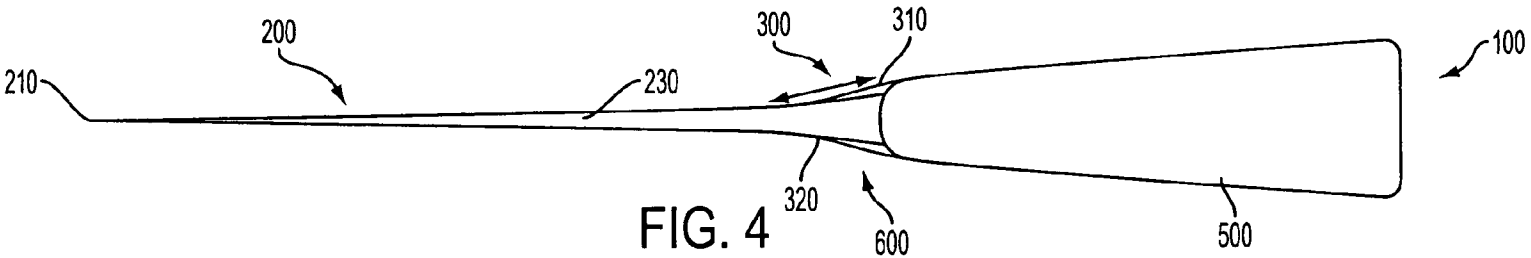
FIG. 4 is a top view of the cutlery implement of FIG. 2.
Figure 5:
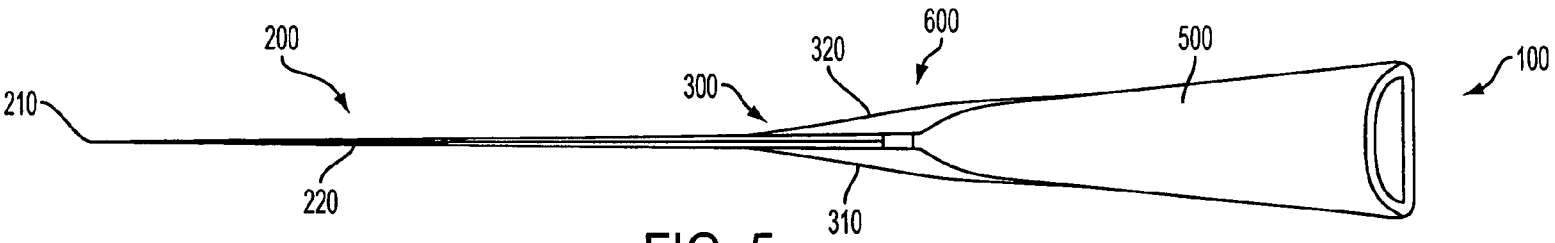
FIG. 5 is a bottom view of the cutlery implement of FIG. 2.
Figure 7:
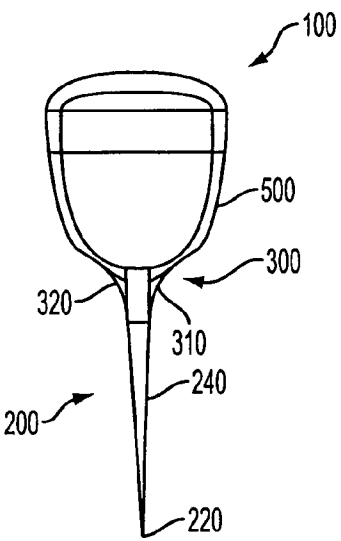
FIG. 7 is a back view of the cutlery implement of FIG. 2.
Figure 6:
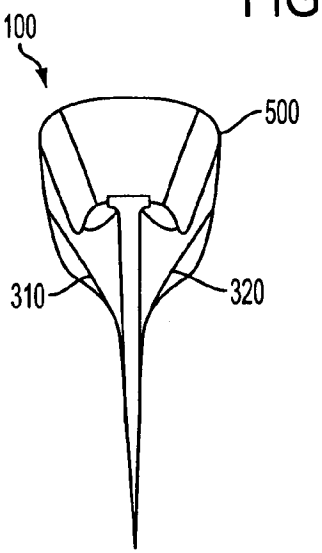
FIG. 6 is a front view of the cutlery implement of FIG. 2.
Figure 8:
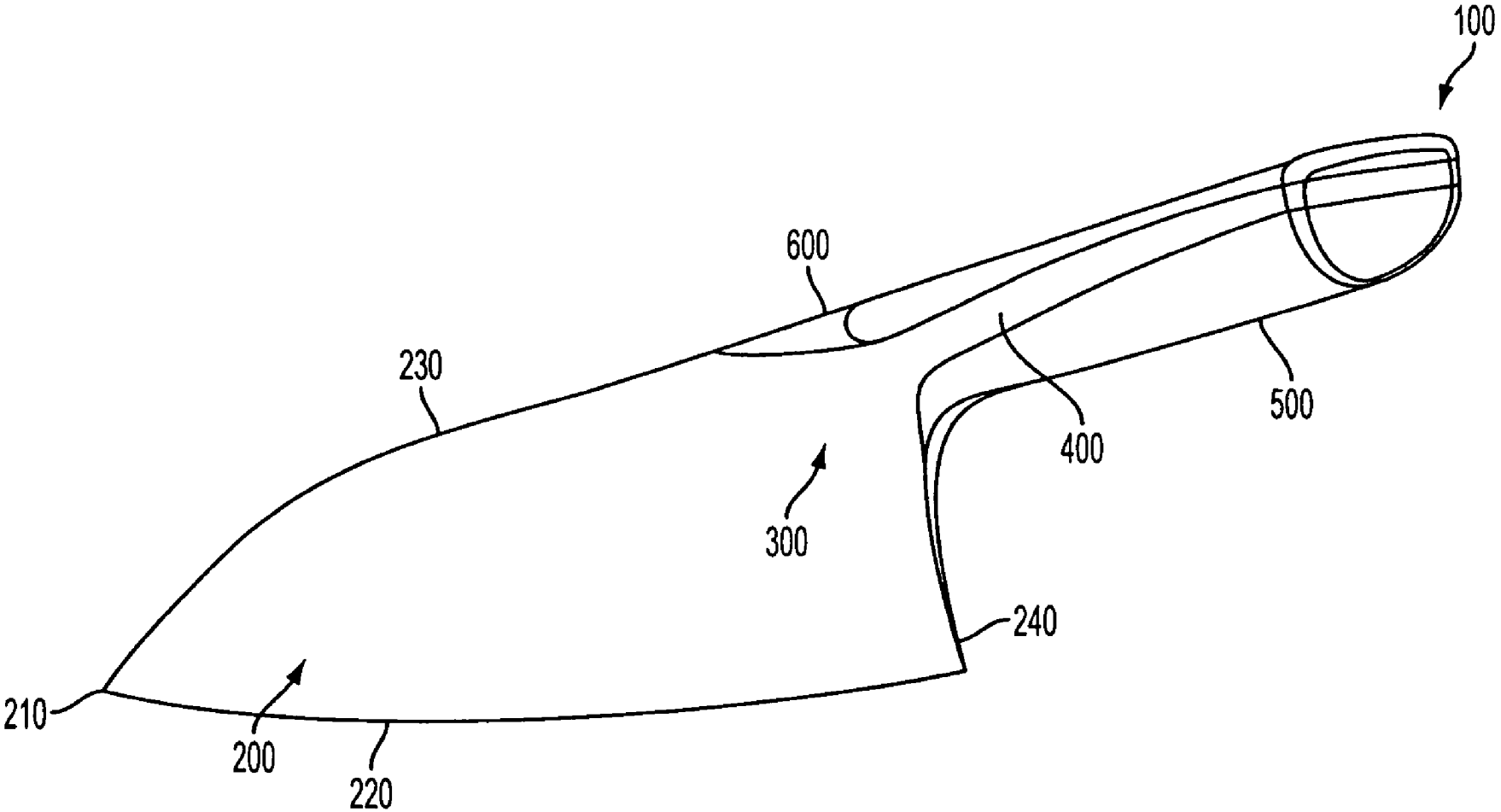
FIG. 8 is a perspective view of the cutlery implement of FIG. 2.

As seen in FIG. 4, the bolster portion 300 of the exemplary embodiment has a first side face 310 and a second side face 320 located opposite each other. The first side face has a concave curve along at least a portion of the length of the bolster portion 300. In addition, the second side face 320 has a concave curve along at least a portion of the bolster portion's 300 length. Preferably, the first side face 310 and the second side face 320 are complimentary.

As illustrated, the first side face 310 and the second side face 320 are tapered from a rearward end near the tang 400 to a forward position where the bolster portion 300 blends with the blade portion 200 at a point forward of the rear edge 240. The cross-sectional area of the bolster portion 300 gradually decreases from the rearward position near the tang 400 to the forward position along the length of the bolster portion 300. In still yet another aspect of the invention, the side faces of the bolster 310, 320 are sandblasted to improve the finish and promote gripping. In another aspect of the invention the side faces of the bolster 310, 320 are polished.

As noted, the bolster portion 300 may have a tapered thickness. The cross-sectional area of the bolster portion 300 as seen in FIGS. 3(*a*)-3(*e*) is largest toward the rear of the bolster portion 300 where it joins the tang 400. Along the length of the bolster portion 300 the cross sectional area of the bolster portion 300 gradually decreases in the direction toward the point 210 creating a gripping position. The bolster portion 300 blends smoothly with the blade portion 200.

Specifically, along the top edge 230 and at cross section 3(*e*) the bolster portion 300 has a width W5. The width W4 of the bolster portion 300, along the top edge 230 at cross section 3(*d*) is less than width W5. Similarly, the width W3 of the bolster portion 300, along the top edge 230 at cross section 3(*c*) is less than width W4. The width W2 of the bolster portion 300, along the top edge 230 at cross section 3(*b*) is less than width W3. Similarly, the width W1 of the bolster portion 300 at cross section 3(*a*) along the top edge 230 is less than the width W5 of the bolster portion 300 at cross section 3(*e*). While the invention is not yet limited to specific dimensions, in an exemplary chef's knife the width of the bolster portion 300 along the top edge of the blade portion 230 from cross section 3(*a*) to 3(*e*) is in the range of 0.097 inches to 0.539 inches, specifically 0.97 inches at W1, 0.211 inches at W2, 0.313 inches at W3, 0.442 inches at W4 and 0.539 inches at W5.

Figure 10A:
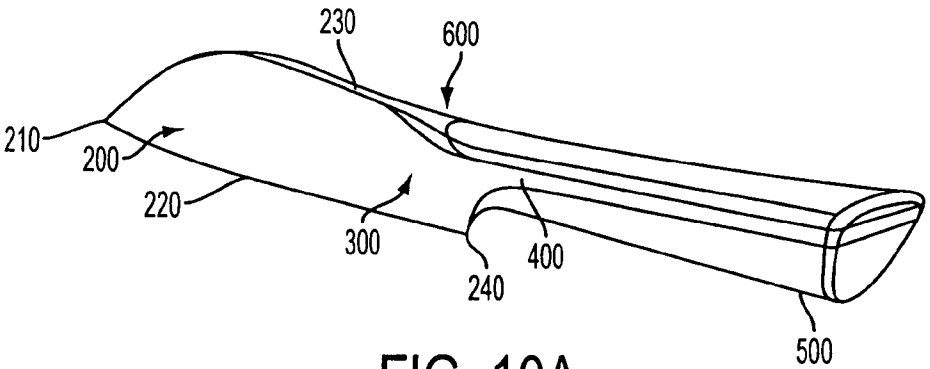
FIG. 10A is a perspective view of a paring knife according to another embodiment of the present invention.
Figure 10B:
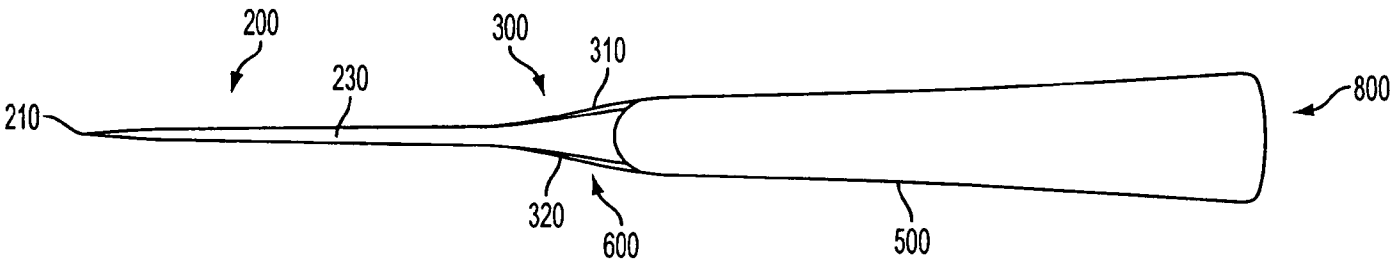
FIG. 10B is a top view of a paring knife according to another embodiment of the present invention.
Figure 10C:
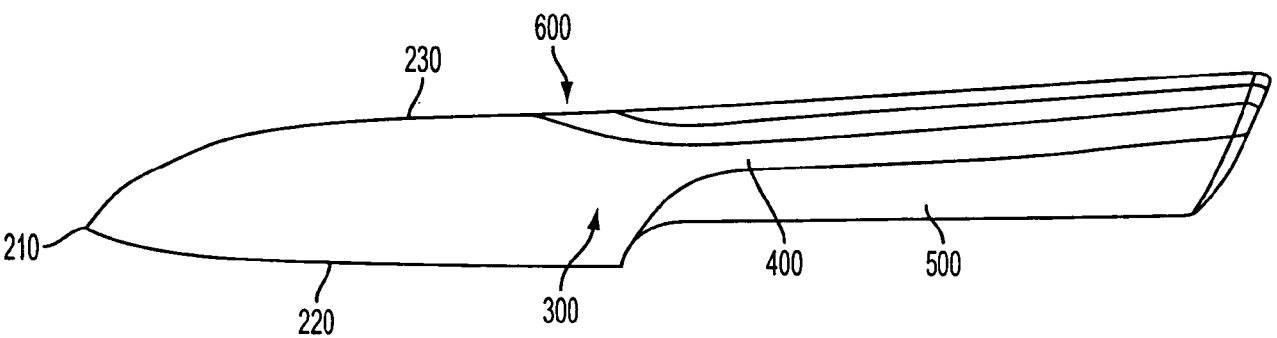
FIG. 10C is a side view of a paring knife according to another embodiment of the present invention.
Figure 10D:
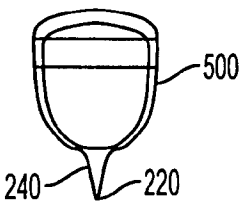
FIG. 10D is a back view of a paring knife according to another embodiment of the present invention.

While a chef's knife is illustrated in the above-described embodiments, it will be appreciated that other sizes and types of knives may employ a bolster using the principles of the present invention. For example, as seen in FIG. 10A, according to an aspect of the present invention, a paring knife 800 has a bolster portion 300 located forward of the back edge 240. In one aspect of the invention the pairing knife 800 has a cutting surface 220 that is well suited for peeling and removing cores from fruit or vegetables.

Figure 11A:
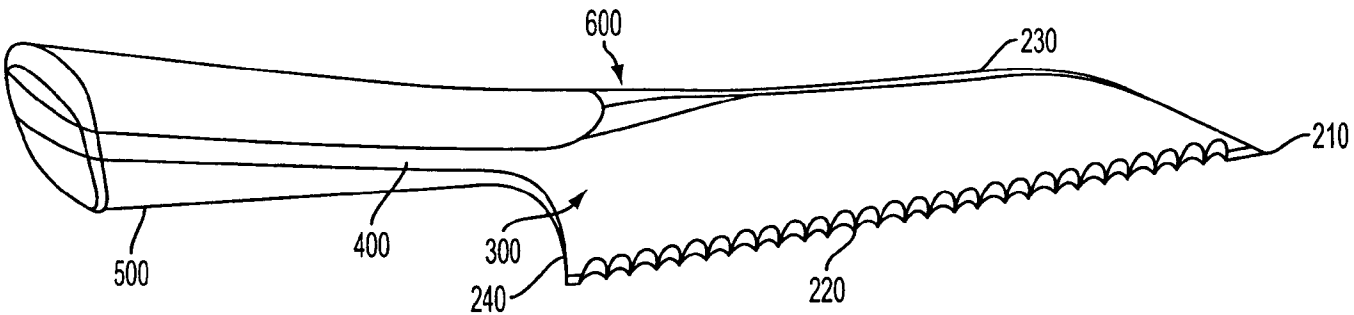
FIG. 11A is a perspective view of a serrated knife according to another embodiment of the present invention.
Figure 11B:
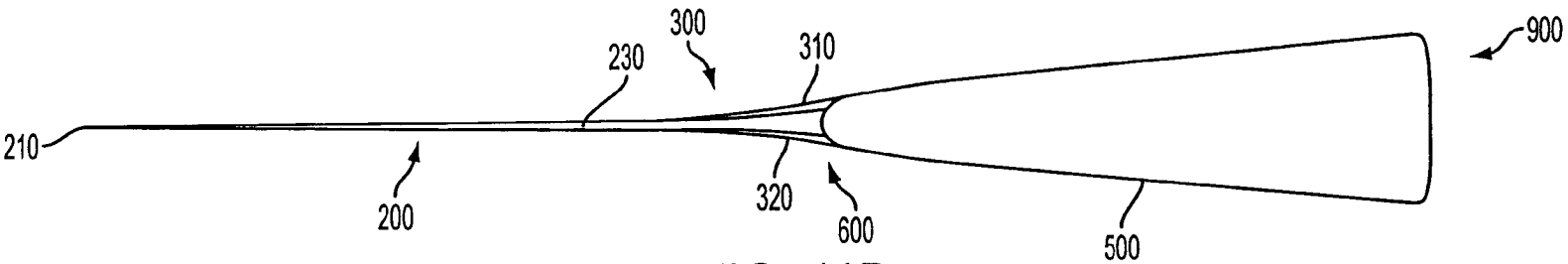
FIG. 11B is a top view of a serrated knife according to another embodiment of the present invention.
Figure 11C:
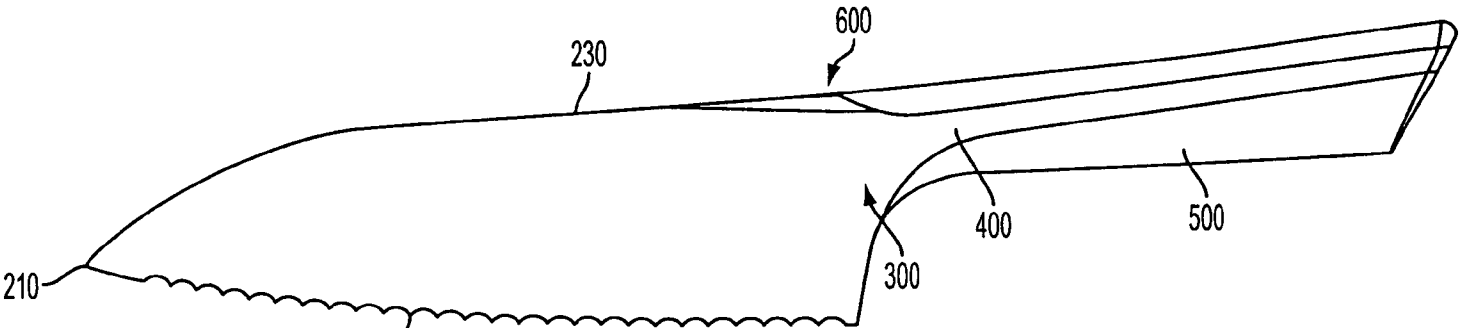
FIG. 11C is a side view of a serrated knife according to another embodiment of the present invention.
Figure 11D:
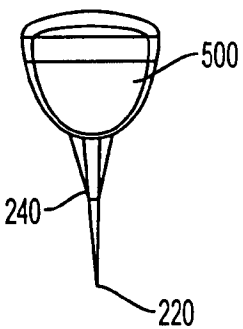
FIG. 11D is a back view of a serrated knife according to another embodiment of the present invention.

As seen in FIG. 11A, in yet another aspect of the invention, a serrated knife 900 has a bolster portion 300 located forward of the rear edge of the blade 240. The serrated knife 900 has a serrated cutting surface 220 and is well suited for use on soft objects such as bread, tomatoes and cake.

Figure 12A:
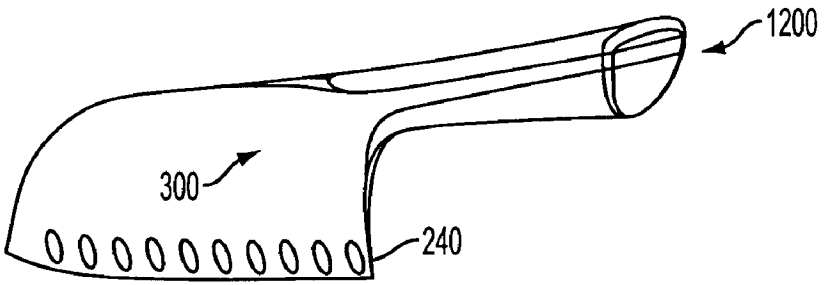
FIG. 12A is a perspective view of a santoku knife according to another embodiment of the present invention.
Figure 12B:
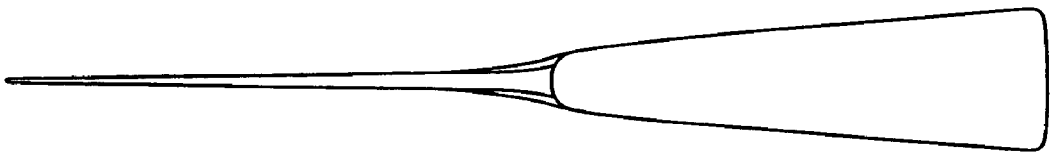
FIG. 12B is a top view of a santoku knife according to another embodiment of the present invention.
Figure 12C:
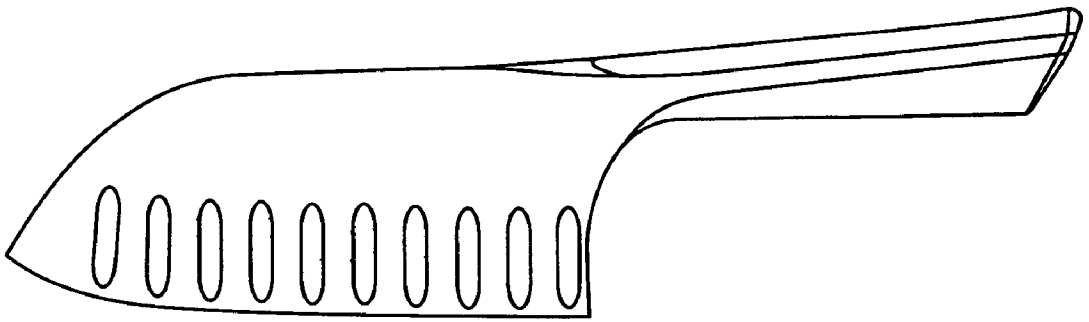
FIG. 12C is a side view of a santoku knife according to another embodiment of the present invention.
Figure 12D:
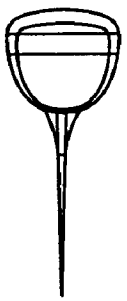
FIG. 12D is a back view of a santoku knife according to another embodiment of the present invention.

FIG. 12A illustrates, according to another embodiment of the present invention, a santoku knife 1200 that has a bolster portion 300 located forward of the rear edge 240.

Figure 13A:
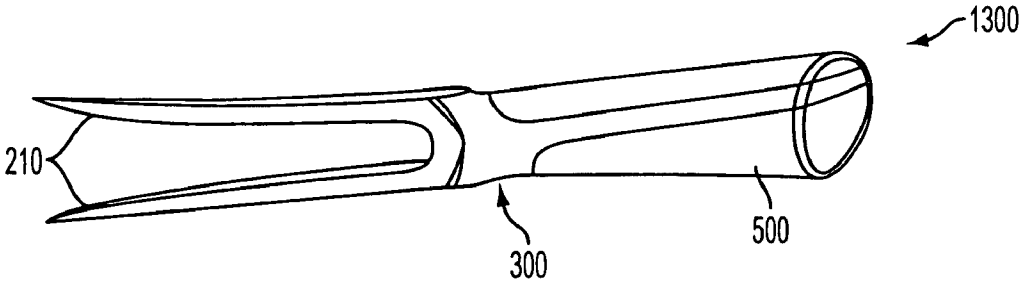
FIG. 13A is a perspective view of a forked knife according to another embodiment of the present invention.
Figure 13B:
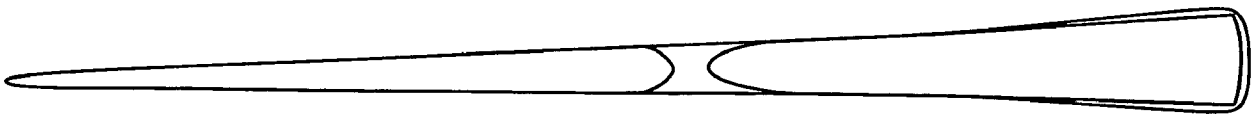
FIG. 13B is a top view of a forked knife according to another embodiment of the present invention.
Figure 13C:
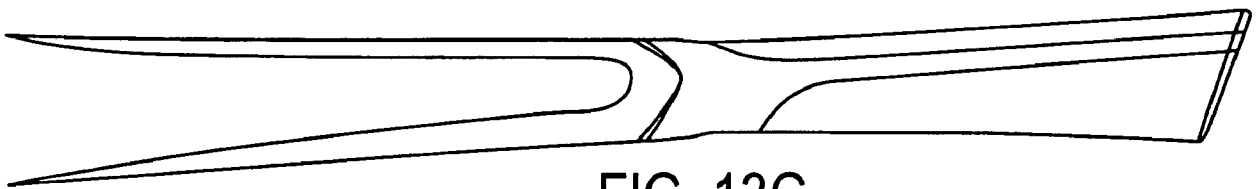
FIG. 13C is a side view of a forked knife according to another embodiment of the present invention.
Figure 13D:
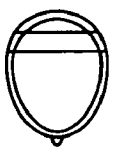
FIG. 13D is a back view of a forked knife according to another embodiment of the present invention.

As seen in FIG. 13A, according to another embodiment of the present invention, a forked knife 1300 has two points 210 and a bolster portion 300 located forward of the handle 500.

Figure 14A:
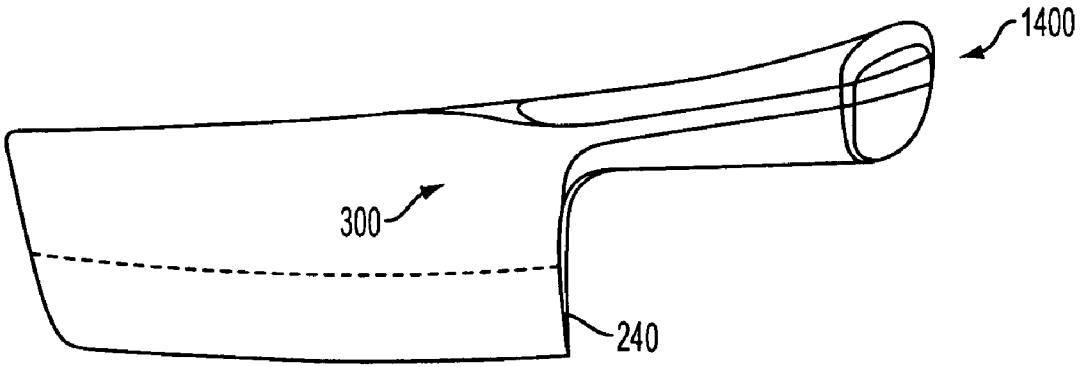
FIG. 14A is a perspective view of a nakiri knife according to another embodiment of the present invention.
Figure 14B:
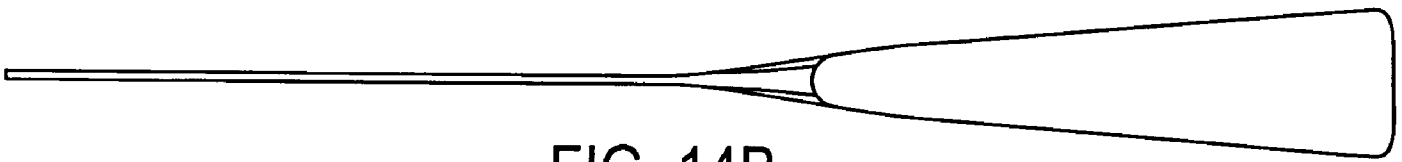
FIG. 14B is a top view of a nakiri knife according to another embodiment of the present invention.
Figure 14C:
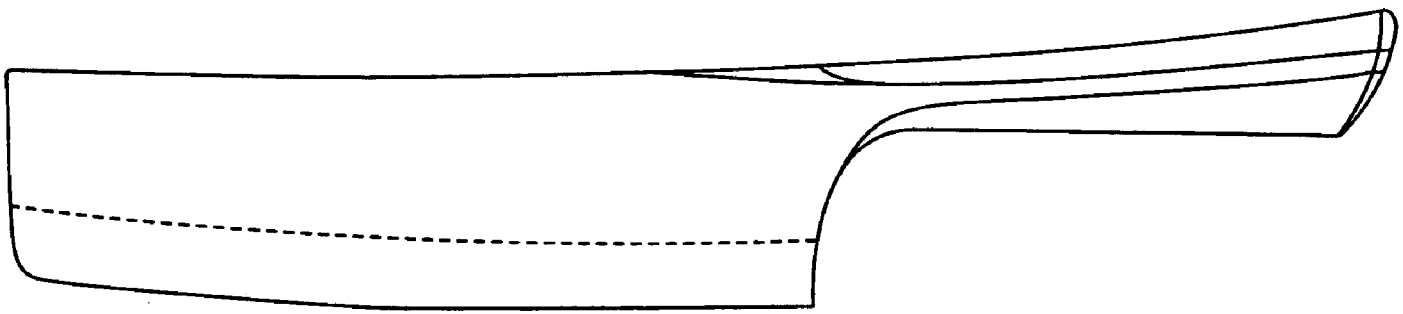
FIG. 14C is a side view of a nakiri knife according to another embodiment of the present invention.
Figure 14D:
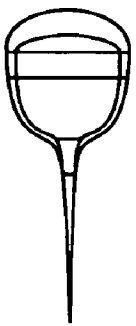
FIG. 14D is a back view of a nakiri knife according to another embodiment of the present invention.

FIG. 14A illustrates, according to another embodiment of the present invention, a nakiri knife 1400 that has a bolster portion 300 located forward of the rear edge 240.

Figure 15:
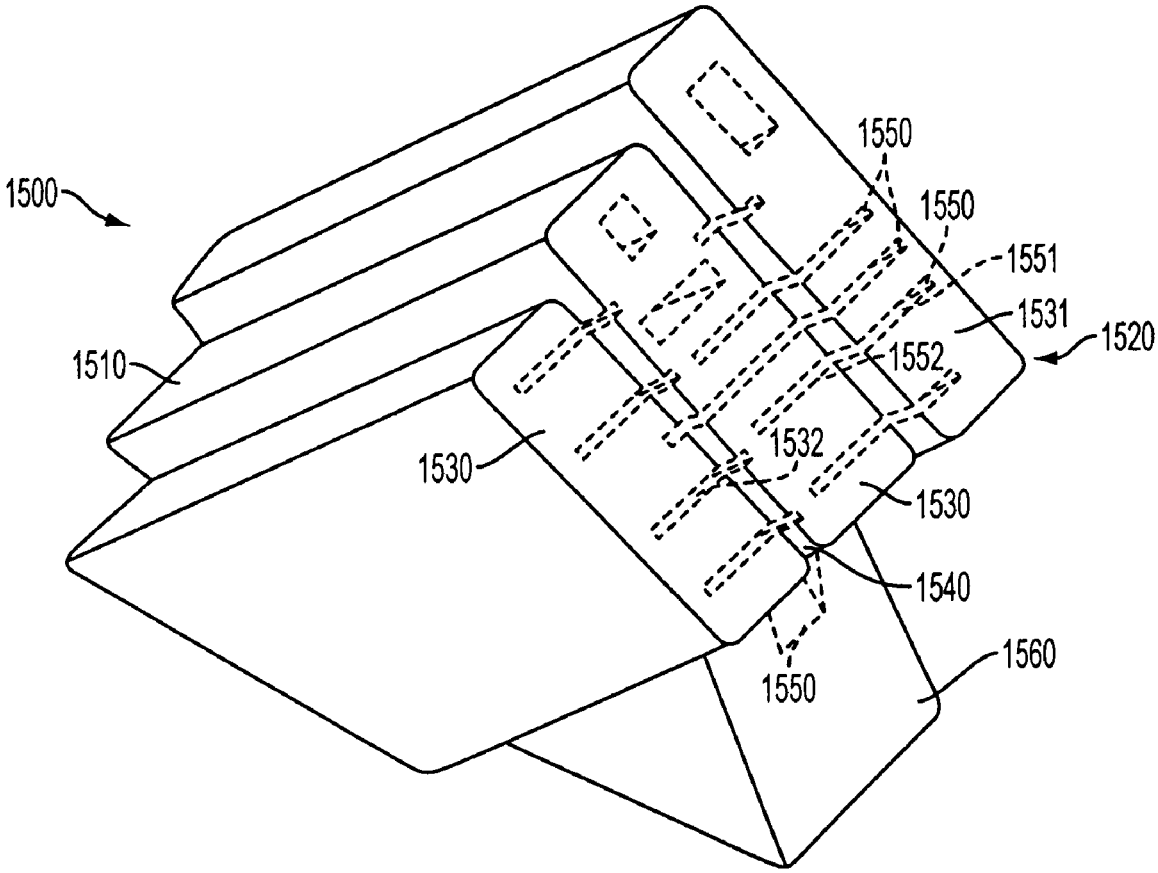
FIG. 15 is a perspective view of the cutlery block according to one embodiment of the invention.
Figure 16A:
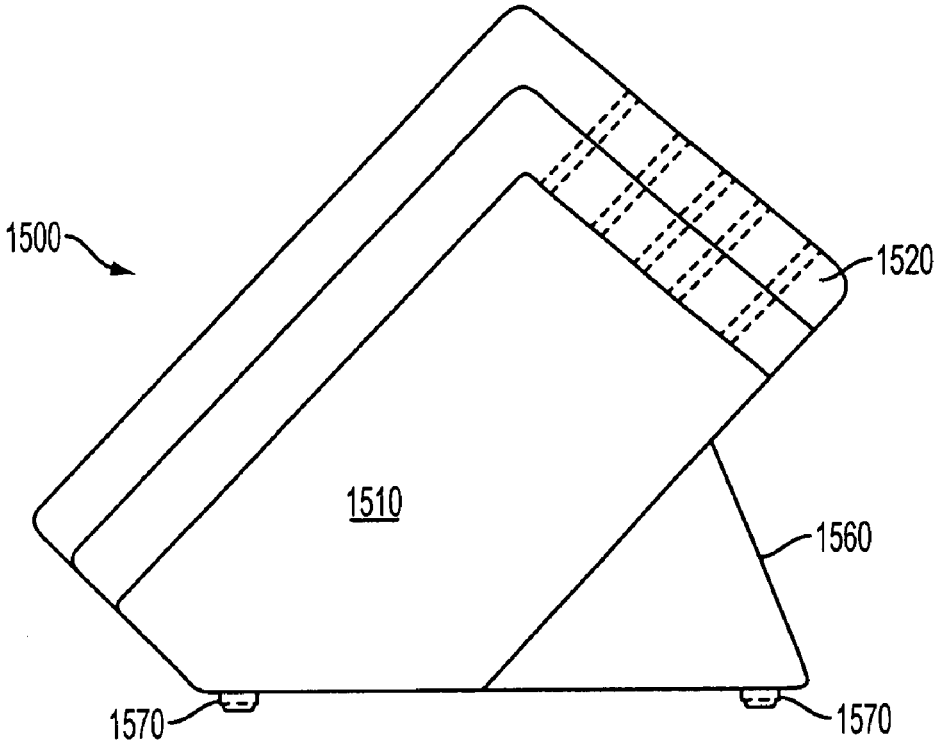
FIG. 16A is a side view of the cutlery block according to one embodiment of the invention.
Figure 16B:
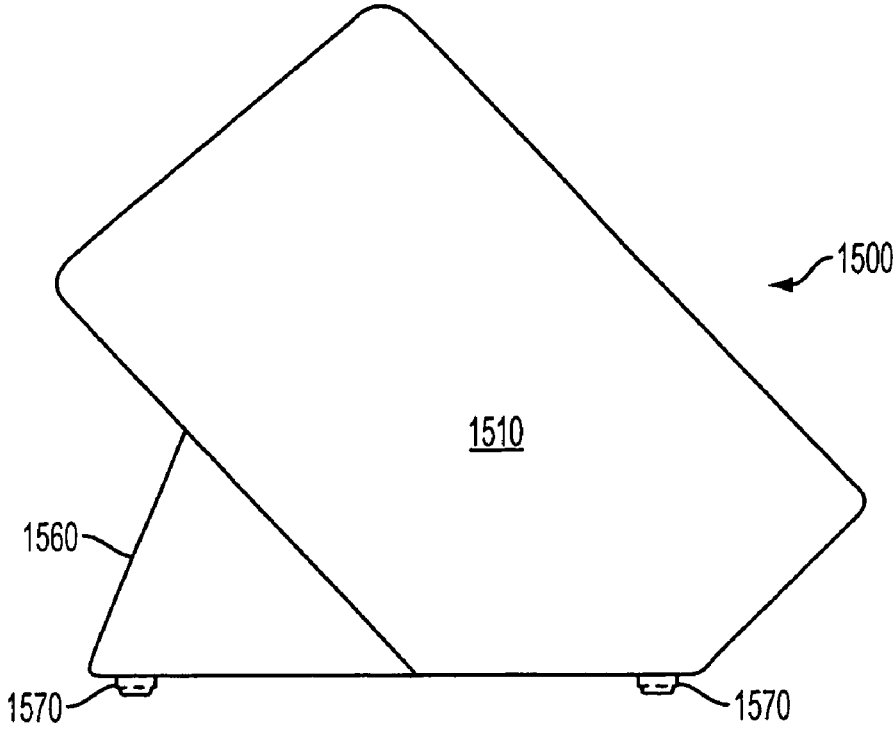
FIG. 16B is a side view of the cutlery block according to one embodiment of the invention.
Figure 17A:
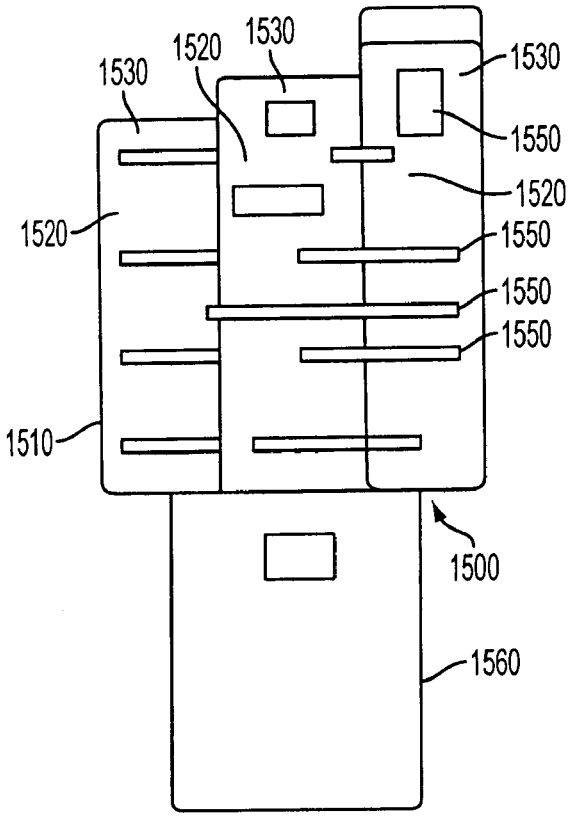
FIG. 17A is a top view of the cutlery block according to one embodiment of the invention.
Figure 17B:
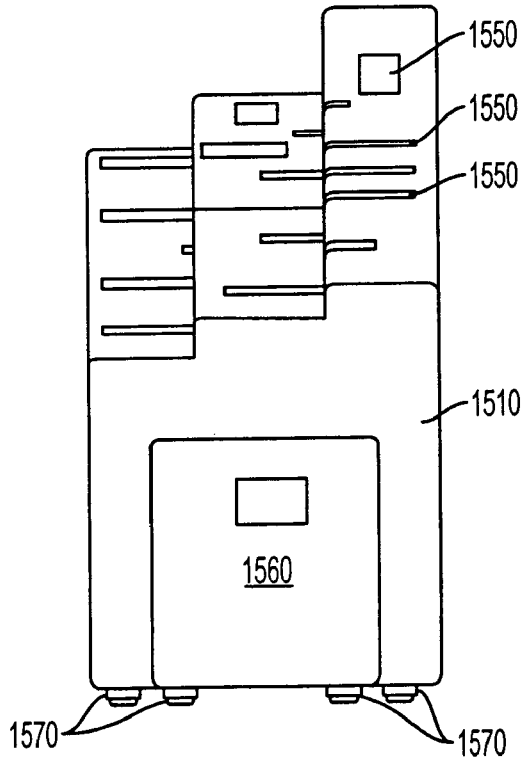
FIG. 17B is a front view of the cutlery block according to one embodiment of the invention.

FIG. 15 shows a cutlery block 1500 according to an exemplary embodiment of the present invention, specifically a tiered cutlery block. The cutlery block 1500 includes a block 1510 having a tiered receiving surface 1520. Each of the tiers 1530 are flat and are in parallel. A transitional surface 1540 is located between each of the plurality of tiers 1530. Each transitional surface 1540 is oriented at a ninety degree angle with both an upper tier 1531 and a lower tier 1532. A plurality of storage slots 1550 each having an upper portion 1551 and a lower portion 1552 are located on the tiered receiving surface 1520. Each storage slot 1550 extends across a lower tier 1532, an upper tier 1531 and a transitional surface 1540 such that the lower portion 1552 of the storage slot 1550 is located on the lower tier 1532 and the upper portion 1551 of the storage slot 1550 is located on the upper tier 1531.

Figure 21:
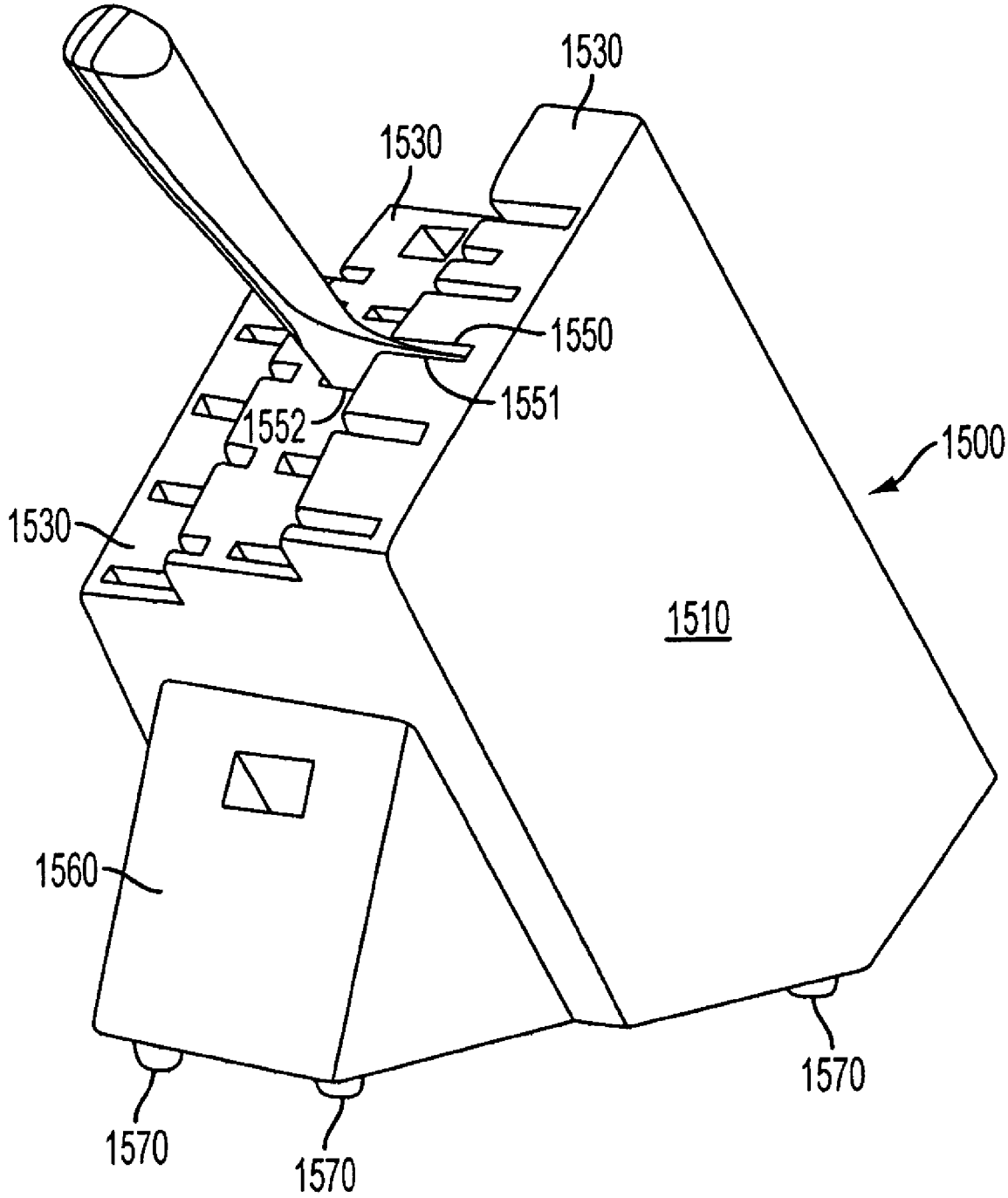
FIG. 21 is a perspective view of a cutlery implement at rest in the cutlery block.

A cutlery implement having a bolster with a tapered thickness may be safely stored in the cutlery block 1500 of FIGS. 15-17B. As seen in FIG. 21, when placed correctly in a storage slot 1550, the cutlery implement is oriented such that the working surface located forward of the bolster is concealed. The working surface located below the bolster is concealed by the upper portion 1551 of the storage slot 1550. The bolster itself is left exposed above a lower portion 1552 of the storage slot 1550.

Figure 18B:
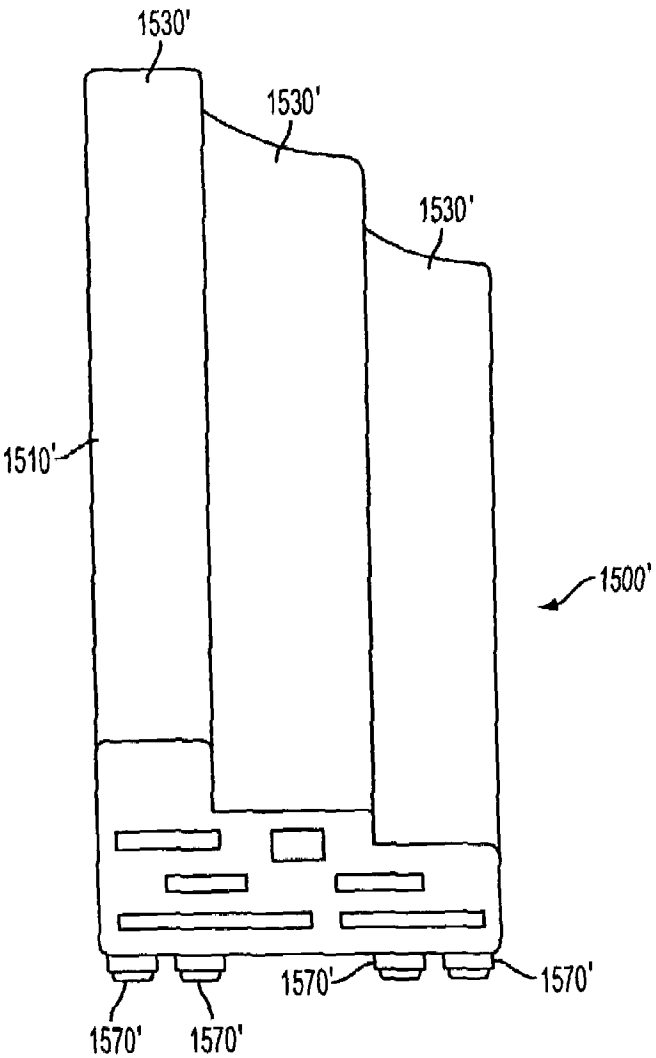
FIG. 18B is a back view of the cutlery block according to one embodiment of the invention.
Figure 18A:
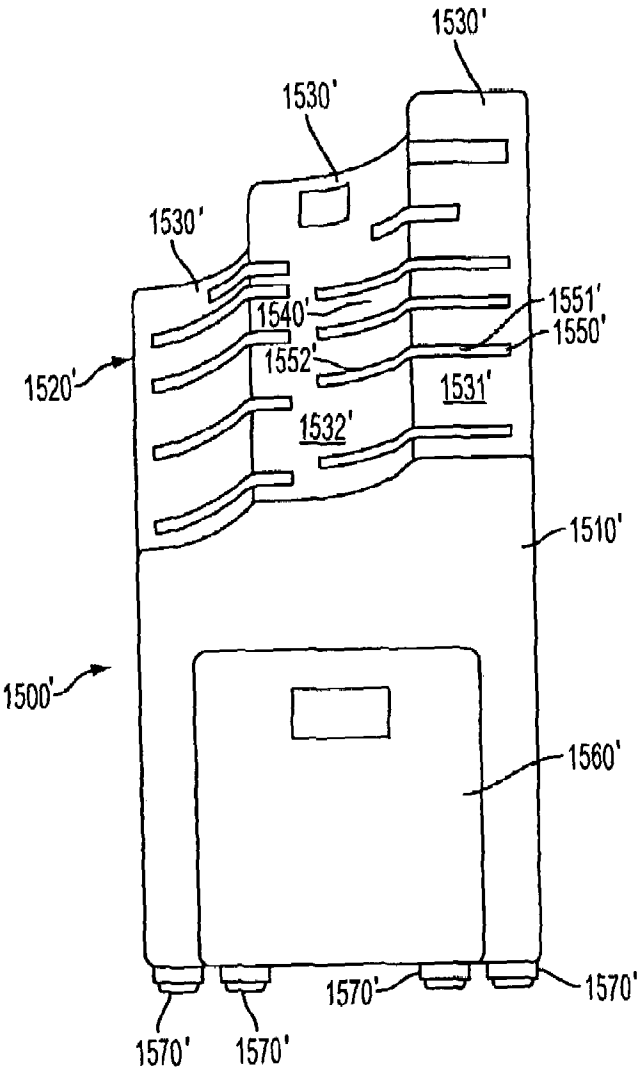
FIG. 18A is a front view of the cutlery block according to one embodiment of the invention.

According to another aspect of the invention, as shown in FIGS. 18A-18B, the receiving surface 1520' of the cutlery block 1500' is oriented in a wave pattern. Each of the tiers 1530' are flat and are in parallel. The transitional surface 1540' positioned between each of the lower tiers 1532' and the upper tiers 1531' is curved. A plurality of storage slots 1550' each having a lower portion 1552' and an upper portion 1551' are located on the receiving surface 1520'. Each storage slot 1550' extends across a lower tier 1532', an upper tier 1531' and a curved transitional surface 1540' such that the lower portion 1552' of the storage slot 1550' is located on the lower tier 1532' and the upper portion 1551' of the storage slot 1550' is located on the upper tier 1531'.

A cutlery implement having a bolster with a tapered thickness may be safely stored in the cutlery block of FIG. 18A-18B. When placed correctly in a storage slot 1550', the cutlery implement is oriented such that the working surface located forward of the bolster is concealed. The working surface located below the bolster is concealed by the upper portion 1551' of the storage slot 1550'. The bolster itself is left exposed above the lower portion 1552' of the storage slot 1550'.

According to another aspect of the invention, as seen in FIG. 15-18B the block 1510, 1510' is connected to a support portion 1560, 1560'. The block 1510, 1510' rests on the support portion 1560, 1560' at an angle. A plurality of base portions 1570, 1570' are mounted to the bottom of the support portion 1560, 1560' and the block 1510, 1510' so that the cutlery block 1500, 1500' is capable of freestanding on a horizontal surface. According to another aspect of the invention, a storage slot 1550, 1550' is disposed on the support portion 1560, 1560'. For example, the storage slot 1550, 1550' disposed on the support portion 1560, 1560' may be suitable for storing shears. In another aspect of the invention the cutlery block 1500, 1500' is made from wood and has a varnished finish. In still another aspect of the invention the block 1510 is constructed by joining three sections of various sizes together to create a tiered receiving surface 1520.

Figure 19:
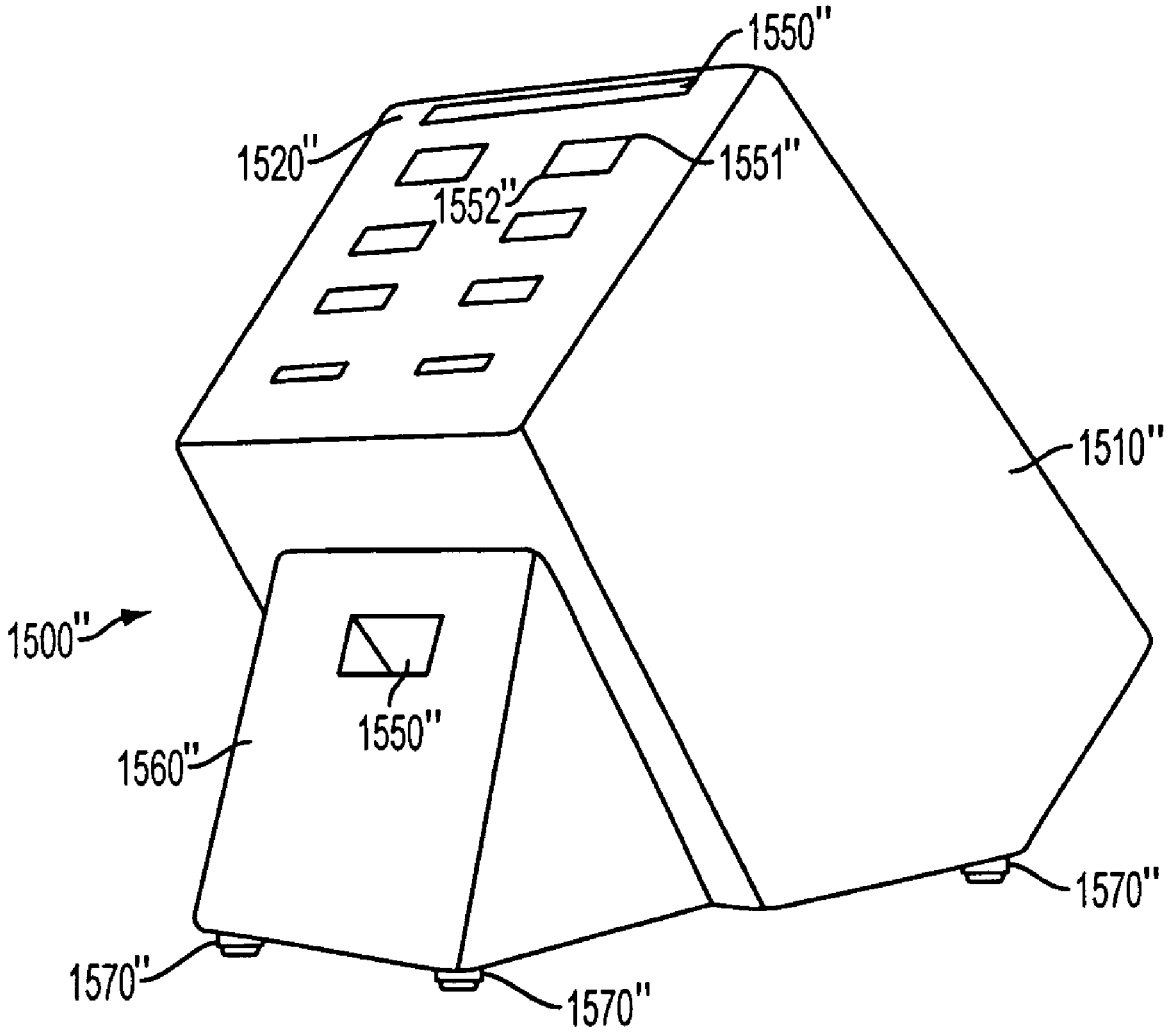
FIG. 19 is a perspective view of the cutlery block according to one embodiment of the invention.
Figure 20:
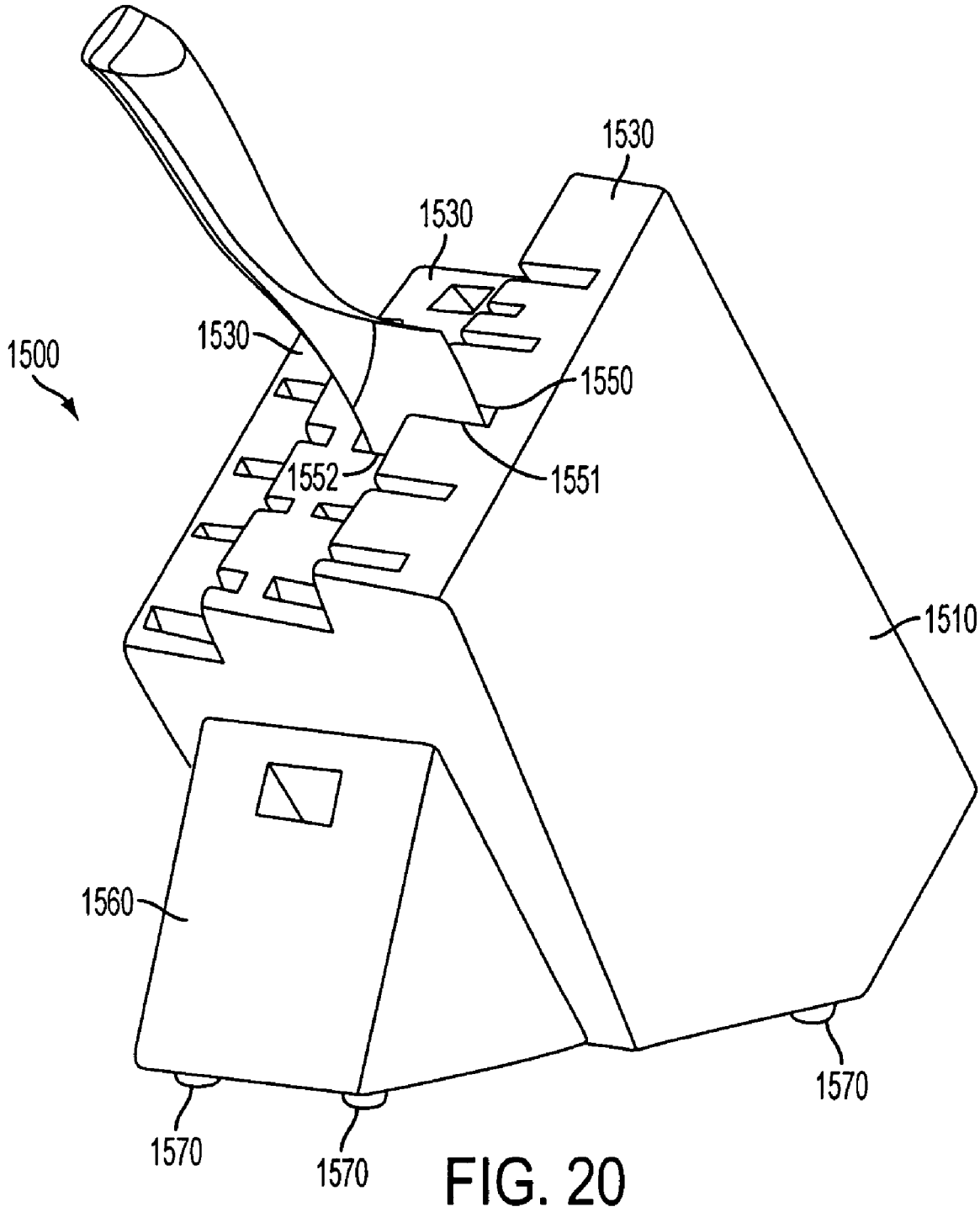
FIG. 20 is a perspective view of a cutlery implement partially inserted into the cutlery block.

While a cutlery block is illustrated in the above-described embodiments, it will be appreciated that other sizes and types of cutlery blocks may employ a design using the principles of the present invention. For example, as seen in FIG. 19, the receiving surface 1520" is configured such that it makes a sharp angle in relation to the block 1510". A plurality of storage slots 1550" each having a lower portion 1552' and an upper portion 1551" are located on the receiving surface 1520". Each storage slot 1550" is oriented on the angled receiving surface 1520" such that the lower portion 1552" is located below the upper portion 1551". When a cutlery implement is placed correctly in a storage slot 1550" of the cutlery block 1500" in FIG. 19, the cutlery implement is oriented such that the working surface located forward of the bolster is concealed. The working surface located below the bolster is concealed by an upper portion 1551" of the storage slot 1550". The bolster itself is left exposed outside the receiving surface 1520", above a lower portion 1552" of the storage slot 1550".

Figure 22:
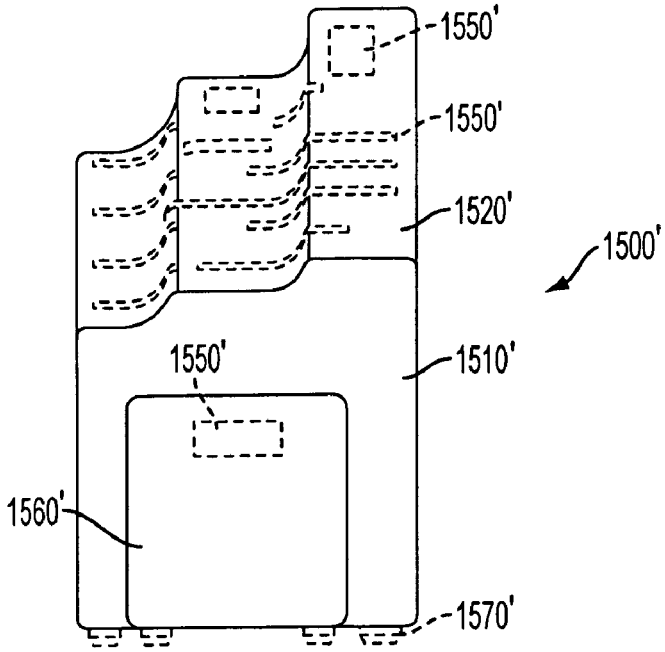
FIG. 22 is a front view of a cutlery block according to one embodiment of the invention.
Figure 23:
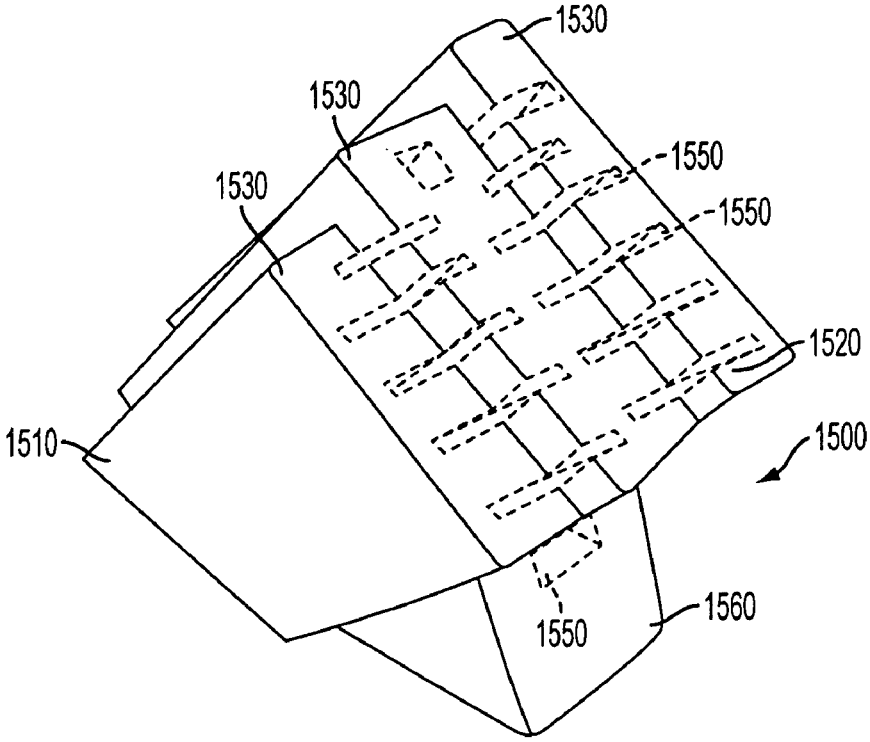
FIG. 23 is a perspective view of a cutlery block according to one embodiment of the invention.

According to another aspect of the invention, as seen in FIGS. 22 and 23, the storage slots 1550, 1550' can be arranged on the receiving surface in a number of configurations. The storage slots 1550, 1550' are of various lengths and widths to accommodate cutlery implements of various sizes and shapes. A storage slot 1550, 1550' may also be located on the base portion 1560, 1560'.

According to certain aspects of the present invention, several advantages are realized. One advantage is that the user experiences comfort and control when gripping the present invention. In addition, certain aspects of the invention aide in minimizing hand fatigue, pain, soreness and blistering. Moreover, certain aspects of the present invention allow the user to hold the cutlery implement safely and securely at its balance point. Another advantage of the present invention is that cutlery implements having bolsters with a tapered thickness can be stored safely and securely.

The foregoing description illustrates various aspects, features and advantages of the invention. Among other features, the invention provides cutlery having a bolster that is comfortable for users.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A cutlery set comprising:

a block having a receiving surface, wherein the receiving surface has a plurality of tiered surfaces and a transitional surface located between each of the plurality of tiered surfaces;

a plurality of cutlery implements;

a plurality of storage slots wherein at least one of the storage slots has a lower portion and an upper portion, configured to receive and store the corresponding plurality of cutlery implements, wherein at least one of the plurality of cutlery implements has a blade portion having a working surface, a handle portion connected to the blade portion and a bolster having a tapered thickness;

wherein at least one of the plurality of storage slots is configured to store at least one of the plurality of cutlery implements so that the working surface of the blade portion located forward of the bolster is concealed within the block beneath the receiving surface, the working surface located below the bolster is concealed by the upper portion of the storage slot and the bolster is left exposed outside the receiving surface, above the lower portion of the storage slot, and wherein at least one of the plurality of storage slots is configured so that the lower portion is positioned on a lower tiered surface and the upper portion is positioned on an upper tiered surface whereby the at least one storage slot extends across the lower tiered surface, the upper tiered surface and the transitional surface located therebetween.

2. A cutlery set of claim 1, further comprising:

a support portion connected to the block; and a plurality of base portions attached to the block and the support portion so that the cutlery block is capable of freestanding on a horizontal surface.

3. A cutlery set of claim 1, wherein each of the plurality of storage slots are rectangular in shape.

4. A cutlery set of claim 1, wherein the receiving surface and the plurality of storage slots are arranged so that each of the plurality of cutlery implements are oriented vertically when they are stored in the storage slots.

5. A cutlery set of claim 1, wherein the block is wood and has a varnished finish.

6. A cutlery set of claim 1, wherein the receiving surface is sloped at an angle.

7. A cutlery set of claim 1, wherein the working surface of the blade portion located forward of the bolster is concealed below the receiving surface, the working surface located below the bolster is concealed by the upper tiered surface and the bolster is left exposed above the lower tiered surface.

8. A cutlery set of claim 1, wherein the receiving surface has three tiered surfaces and a transitional surface positioned between each tiered surface.

9. A cutlery set of claim 1, wherein each of the plurality of tiered surfaces is flat.

10. A cutlery set of claim 1, wherein the transitional surface between each of the plurality of tiered surfaces is at a ninety degree angle with each of the plurality of tiered surfaces.

11. A cutlery set of claim 1, wherein the transitional surface between each of the plurality of tiered surfaces is curved.

12. A cutlery block comprising:

a block having a receiving surface, wherein the receiving surface has a plurality of tiered surfaces and a transitional surface located between each of the plurality of tiered surfaces;

a plurality of storage slots wherein at least one of the storage slots has a lower portion and an upper portion, configured to receive and store a corresponding plurality of cutlery implements, wherein at least one of the plurality of cutlery implements has a blade portion having a working surface, a handle portion connected to the blade portion and a bolster having a tapered thickness;

wherein at least one of the plurality of storage slots is configured to store at least one of the plurality of cutlery implements so that the working surface of the blade portion located forward of the bolster is concealed within the block beneath the receiving surface, the working surface located below the bolster is concealed by the upper portion of the storage slot and the bolster is left exposed outside the receiving surface, above the lower portion of the storage slot, and wherein at least one of the plurality of storage slots is configured so that the lower portion is positioned on a lower tiered surface and the upper portion is positioned on an upper tiered surface whereby the at least one storage slot extends across the lower tiered surface, the upper tiered surface and the transitional surface located therebetween.

13. A cutlery block of claim 12, further comprising:

a support portion connected to the block; and a plurality of base portions attached to the block and the support portion so that the cutlery block is capable of freestanding on a horizontal surface.

14. A cutlery block of claim 12, wherein each of the plurality of storage slots are rectangular in shape.

15. A cutlery block of claim 12, wherein the receiving surface and the plurality of storage slots are arranged so that each of the plurality of cutlery implements are oriented vertically when they are stored in the storage slots.

16. A cutlery block of claim 12, wherein the block is wood and has a varnished finish.

17. A cutlery block of claim 12, wherein the receiving surface is sloped at an angle.

18. A cutlery block of claim 12, wherein the receiving surface has three tiered surfaces and a transitional surface positioned between each tiered surface.

19. A cutlery block of claim 12, wherein each of the plurality of tiered surfaces is flat.

20. A cutlery block of claim 12, wherein the transitional surface between each of the plurality of tiered surfaces is at a ninety degree angle with each of the plurality of tiered surfaces.

21. A cutlery block of claim 12, wherein the transitional surface between each of the plurality of tiered surfaces is curved.

* * * * *